United States Patent [19]

Bourdon

[11] Patent Number: 4,725,931

[45] Date of Patent: Feb. 16, 1988

[54] COVE FIXTURE

[75] Inventor: Claude Bourdon, Boisbriand, Canada

[73] Assignee: Monitronik Ltee., Boisbriand, Canada

[21] Appl. No.: 936,438

[22] Filed: Dec. 1, 1986

[51] Int. Cl.[4] ..... F21S 1/02

[52] U.S. Cl. ..... 362/151; 362/147; 362/217; 362/220

[58] Field of Search ..... 362/147, 151–153, 362/217, 219, 220, 224, 225, 250, 260, 285, 429, 430; 339/21 S, 50 R, 52 R, 57; 248/295.1, 297.2, 307

[56] References Cited

U.S. PATENT DOCUMENTS

| | | | |
|---|---|---|---|
| 2,169,022 | 8/1939 | Chubb | 40/548 |
| 2,300,447 | 11/1942 | Glukes | 40/444 |
| 2,597,584 | 5/1952 | Hopkins | 340/106 |
| 3,202,814 | 8/1965 | Ceglia | 362/219 |
| 3,379,869 | 4/1968 | Dorman | 362/231 |
| 3,389,248 | 6/1968 | Abrams | 362/231 |
| 3,425,146 | 2/1969 | Winstanley | 409/581 |
| 3,790,772 | 2/1974 | Newman | 40/444 |
| 3,868,501 | 2/1975 | Barbour | 40/442 |
| 3,997,991 | 12/1976 | Hayman-Chaffey | 40/361 |
| 4,005,538 | 2/1977 | Tung | 40/564 |
| 4,251,855 | 2/1981 | Radek | 362/151 |

*Primary Examiner*—Samuel Scott
*Assistant Examiner*—Noah Kamen
*Attorney, Agent, or Firm*—Nixon & Vanderhye

[57] ABSTRACT

The cove fixture described herein is formed of an extruded elongated trough body having a series of grooves on the inner face of its side walls, an additional wall extends upwardly from within the body and includes also a groove longitudinally thereof. A fluorescent supporting plate is slidably mounted in the grooves so that one or more fluorescent lamp may be longitudinally adjusted in the body to provide optimum light distribution over the wall of a room where the light fixture is mounted.

18 Claims, 7 Drawing Figures

COVE FIXTURE

FIELD OF THE INVENTION

The present invention relates to a cove fixture and, more particularly, to such fixture for indirect lighting.

BACKGROUND OF THE INVENTION

Cove fixtures generally serve to conceal light. They usually take the shape of a concave trough in which are concealed a series of fluorescent lamps. In most cases, they extends the entire length of a room with the back wall of the trough attached to the wall of a room near the ceiling; they may also extend between and mounted to transverse supports or hang freely. One problem usually associated with such fixtures is that, whenever the dimensions of a room are altered, the coves must be arranged so as to provide uniform distribution of light on the ceiling. These coves, are of a standard size; thus in rearranging the coves to suit the new size of the room some cove fixtures must be removed or added but, very often, the total length of the coves does not equal that of the room wall whereby some dark areas are left on the lit wall where there is a gap between the cove fixtures. To overcome the problem of having a non-continuous length of cove fixtures along a room wall, some cove fixtures have been divised so as to be cut to complete the overall length; however, in these cases, there still remains the problem of dark spots on the ceiling as a result of the absence of light being emitted from those cut cove fixtures.

OBJECTS AND STATEMENT OF THE INVENTION

It is an object of the present invention to overcome the above problems. This is achieved by providing a cove fixture where the lamps inside the entire fixture arrangement may be adjustably positioned to provide optimum light distribution on the ceiling of a room.

The present invention provides a trough body having grooves so that the accessories supporting the fluorescent lamps may be slidably moved within the body thus allowing the lamps to be positioned in the cove fixture in a way that distribution of light on the ceiling may be made uniform.

The present invention, therefore, relates to a cove fixture for indirect lighting which comprises, in its broadest aspect, an extruded elongated trough body having a first wall means for mounting to a building structure and a second wall means extending outwardly and upwardly from the lower portion of the first wall means; a third wall means extending upwardly from the inner face of the second wall means a first support means extend lengthwise of the inner face of first wall means while a second support means extend lengthwise of one face of the third wall means and in substantially facing horizontal alignment with the first support means. The opposite ends of fluorescent-supporting plate means are removably and slidably mounted in the first and second support means respectively so that one or more fluorescent lamps received within the body may be longitudinally adjusted therein to provide optimum light distribution in a room wherein said light fixture is mounted.

In one preferred form of the invention, further groove means are provided to allow the assembly of an associated juxtaposed similarly constructed cove fixture in longitudinal alignment with said fixture so that adjustment of a lamp may be made in two adjacent cove fixtures.

Other objects and further scope of applicability of the present invention will become apparent from the detailed description given herinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

For a better understanding of the present invention, reference is add to the following description taken in connection with the accompanying drawings in which.

DESCRIPTION OF THE PREFERRED EMBODIMENTS

Figure 1:
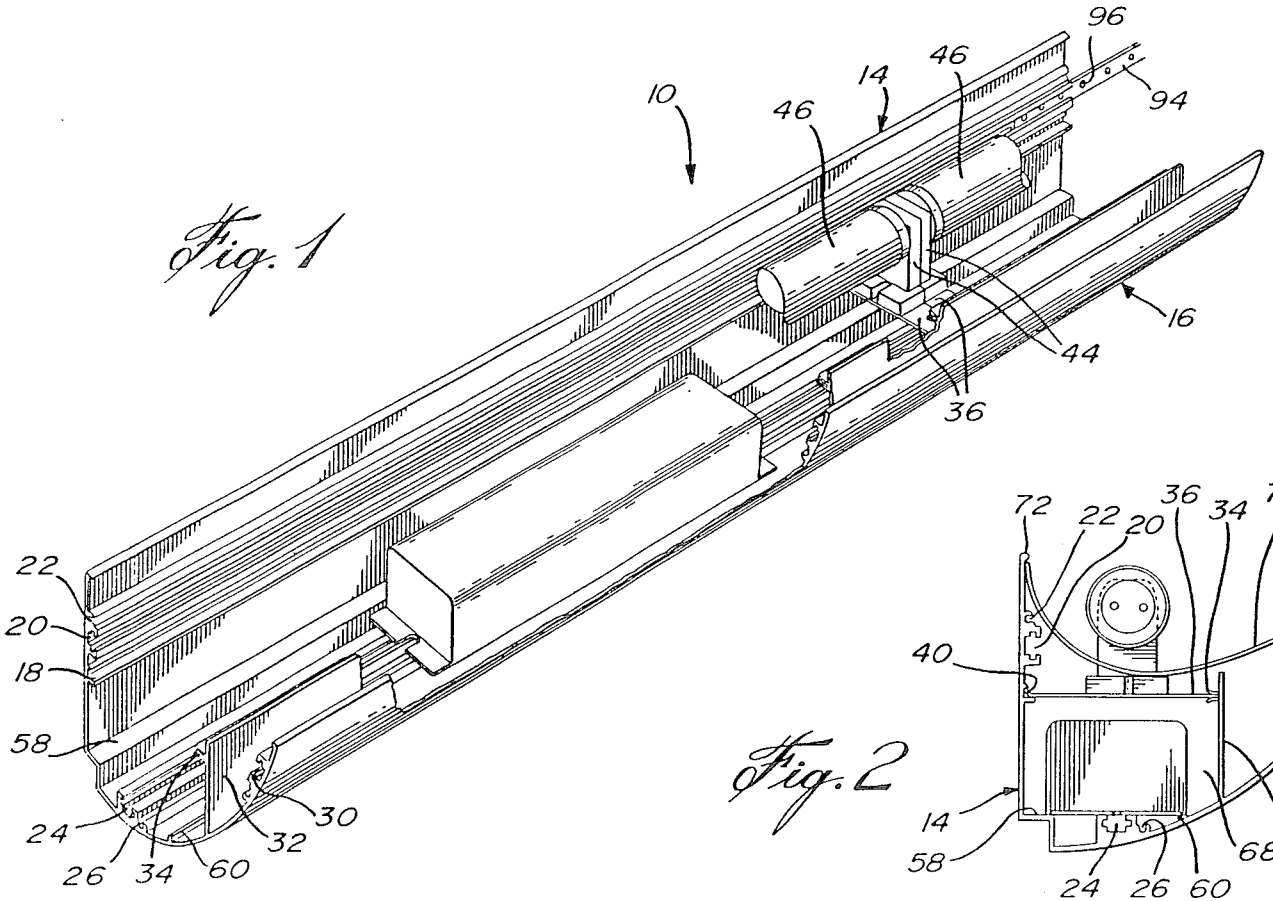
FIG. 1 is a top perspective view, with parts broken away, showing one embodiment of a cove fixture made in accordance with the present invention.
Figure 2:
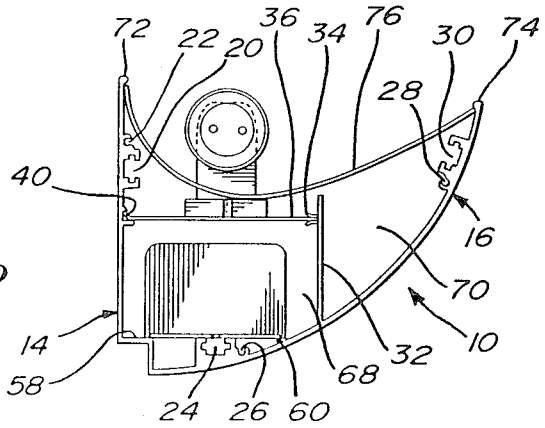
FIG. 2 is an end view of the cove fixture shown in FIG. 1.

Referring to FIGS. 1 and 2, there is shown a cove fixture, generally denoted 10, consisting of elongated concave trough body having a rear vertical side-wall 14 and an outwardly and upwardly extending curved front wall 16. The vertical side-wall 14 is adapted to be mounted to the wall of a building structure, preferably adjacent the ceiling of a room.

The vertical wall 14 of the trough body has, on the inner face thereof, a series of longitudinal horizontally extendig grooves 18, 20 and 22 while the curved wall 16 has, on its inner face, a series of longitudinal grooves 24, 26, 28 and 30; the function of these grooves will be described further hereinbelow.

Upwardly extending from the inner face of the curved wall 16, is a third wall 32 having its lower part integrally formed of the curved wall while the upper part thereof includes a longitudinal horizontally extending groove 34 which is in horizontal alignment with groove 18 of the vertical wall 14.

Figure 3:
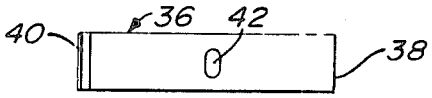
FIG. 3 is a top plan view of a supporting plate means of the present invention.

FIG. 3 shows a plate 36 which has a straight edge 38 engageable in groove 34 and an opposite upwardly inclined edge 40 which is engageable in groove 18. Plate 36 has a central opening 42 for securing an electrical socket 44 by appropriate fastening means (not shown). With reference to FIG. 1, there are shown two plates 36 arranged side-by-side each carrying a respective socket 44. These sockets serve to electrically connect one or more fluorescent lamps 46.

Figure 4:
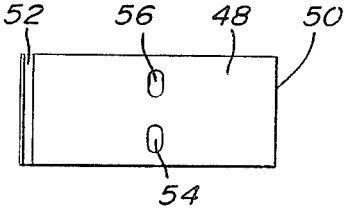
FIG. 4 is a top plan view of a variant of the supporting plate means.

FIG. 4 shows a variant of plate 36; it consists of a larger plate 48 with edges 50 and 52 engaging the respective grooves 34 and 18; a pair of openings 54, 56 serve to secure a pair of sockets 44.

The inner face of the curved wall 16 displays two longitudinally extending shoulder portions 58 and 60 on which rest opposite edges of a ballast device 62 for the operation of the fluorescent lamps. The top edges 64 and 66 of groove 24 are in horizontal alignment with shoulders 58 and 60 so that the ballast device may also rest thereon.

Wall 32 forms a partition defining a pair of chambers 68 and 70, the former enclosing the ballast device while the latter receives electrical wires (not shown) connecting the fixture to an electrical outlet (not shown).

The upper free extremities of walls 14 and 16 define projecting portions 72, 74 defining a lip underneath which is engaged the edges of a flexed reflector 76. This reflector extends between a pair of sockets and underneath the fluorescent lamp. Such reflector is well known in the art and will not be described in detail; they include an upper reflective surface for reflecting light.

Grooves 22, 26 and 28 which extend longitudinally of the cove fixture serve only at the opposite ends of the fixture means, such as screws, to secure end plates, having a shape corresponding to the cross-sectional shape of the cove fixture, for closing, if required, the opposite ends of the trough body.

Figure 5:
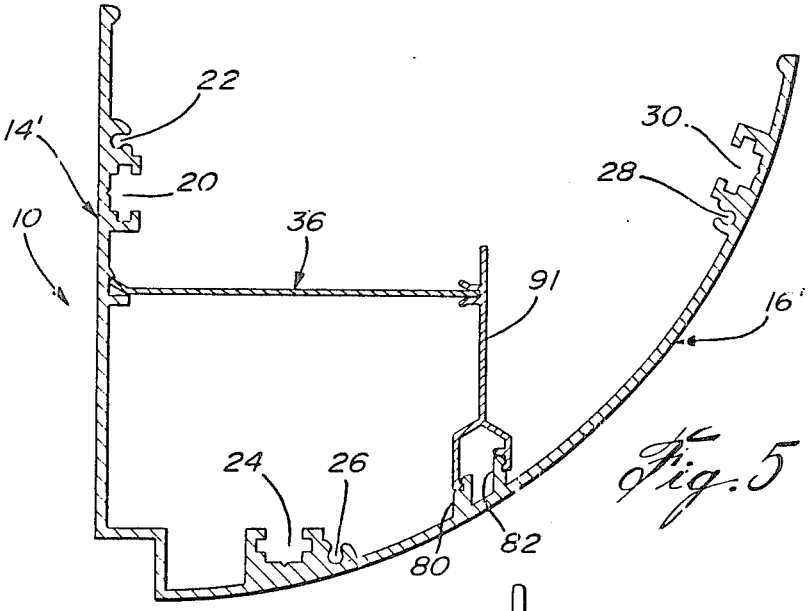
FIG. 5 is a cross-sectional side view showing another embodiment of a cove fixture made in accordance with the present invention.
Figure 6:
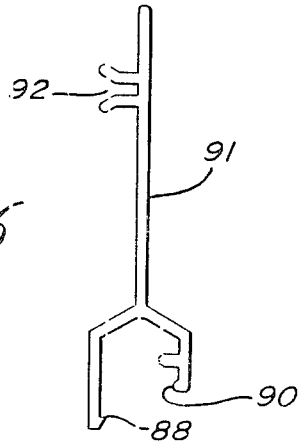
FIG. 6 is an elevational view of a supporting wall forming plan of the cove fixture of FIG. 5.

Referring to FIG. 5, a cove fixture 10 resembling cove fixture 10' is shown. The inner faces of walls 14' and 16' are identical to that of walls 14 and 16 with the exception of two projecting ribs 80 and 82. Each of these ribs includes side grooves in which are engaged the projections 88 and 90 (see FIG. 6) of the lower part of a removable portion wall 91. This walls displays a longitudinal groove 92 the function of which is the same as that of groove 34 in FIG. 1, that is to support plate 36.

Grooves 20, 24 and 30 of the cove fixtures shown in FIGS. 1 and 5 serve to receive coupling rods, such as that shown as 94 in FIG. 1, allowing similarly constructed cove fixtures to be mounted in a juxtaposed arrangement. Hence, cove fixtures may be cut to suit the exact length of a room and are then connected by means of these coupling rods which are slid in aligned grooves of adjacent fixtures. Holes 96 in these rods allow fastening means, such as screws, to secure the rods in the grooves. Thus, with a series of cove fixtures arranged in juxtaposed fashion in accordance with the present invention and disposed along the entire length of a wall, the fluorescent lamps within the fixtures may be adjusted lengthwise by sliding the plates 36 (36' or 48) in their grooves to provide optimum light distribution on an adjacent ceiling. Similarly, the ballast device 62 for each fluorescent lamp may be slid on the shoulder portions of the trough body. If desired, end plates may be mounted at opposite ends of the body to hide the contents of the cove fixture; this is achieved by securing the end plates to the cove fixtures by means of screws which engage the respective grooves 22, 26 and 28 of the body.

Figure 7:
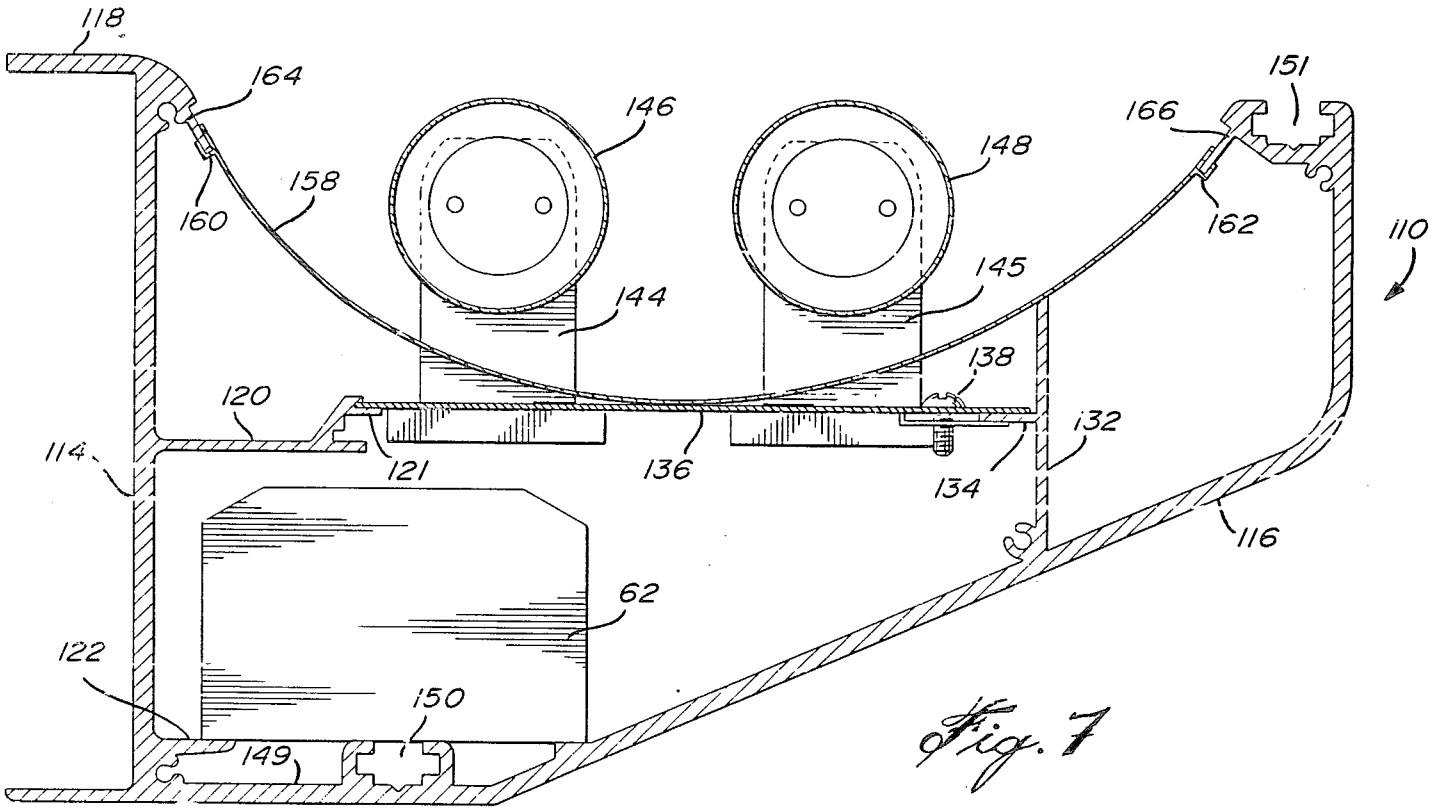
FIG. 7 is a cross-sectional side view showing another embodiment of a cove fixture made in accordance with the present invention.

Referring to FIG. 7, there is shown another embodiment of a cove fixture made in accordance with the present invention. It consists of a trough body 110 somewhat larger in cross-section than body 10 described above, with a rear vertical side wall 114 and an outwardly and upwardly extending front wall 116. The vertical side wall 114 is structured to be mounted to the wall of a building structure as explained above. The inner face of vertical wall 114 has a series of horizontal longitudinally extending supports 118, 120 and 122.

Upwardly extending from and integral with the inner face of the front wall 116, a third wall 132 has, at its upper part, a horizontal longitudinally extending edge 134.

A plate 136, of the type illustrated in FIGS. 3 and 4, is supported on a projecting edge 121 of support 120 and secured to the edge 134 by means of an attachment screw 138. In this embodiment, plate 136 is structured with openings (not shown) to fixedly receive a pair of electrical sockets 144, 145 into which are connected the ends of two fluorescent lamps 146, 148, respectively.

The trough body 110 has, integrally formed in its inner bottom wall 149, a longitudinal groove 150 and, integrally formed at the upper extremity of its front wall 116, a second groove 151, both grooves adapted to receive coupling rods, such as that shown as 94 in FIG. 1, thus allowing similarly constructed cove fixtures to be mounted in a juxtaposed arrangement.

A flexed reflector 158 has its opposite ends 160 and 162 adapted to engage respective edges 164, 166 of the rear wall 114 and front wall 116 and extends beneath lamps 146 and 148.

Although the invention has been described above with respect to three separate forms, it will be evident to the person skilled in the art that it may be refined and modified in various ways. It is therefore wished to have it understood that the present invention should not be limited in interpretation, except by the terms of the following claims.

The embodiments of the invention in which an exclusive property of privilege is claimed are defined as follows:

1. A cove fixture for indirect lighting comprising:

an extruded elongated trough body having a first generally vertically extending wall means for mounting to a building structure and a second wall means extending outwardly and upwardly from the lower extremity of said first wall means;

a third wall means extending upwardly from an inner face of said second wall means;

first support means extending lengthwise of an inner face of said first wall means;

second support means extending lengthwise of one face of said third wall means and facing in substantially horizontal alignment said first support means;

lamp-supporting plate means having opposite ends thereof removably and slidably mounted in said first and second support means, whereby one or more lamps received within said body may be longitudinally adjusted therein to provide optimum light distribution in a room wherein said fixture is mounted.

2. A fixture as defined in claim 1, further comprising third support means extending lengthwise of the inner face of said second wall means for supporting a ballast device for a fluorescent lamp used with said cove fixture.

3. A fixture defined in claim 2, wherein said third support means consists of a shoulder portion formed in the lower part of said first wall means.

4. A fixture as defined in claim 1, wherein said trough body is substantially concave with said second wall means being frontwardly curved.

5. A fixture as defined in claim 1, wherein said first and second wall means form a unitary body made of aluminum material.

6. A fixture as defined in claim 1, wherein the lower edge of said third wall means is integrally formed of said body.

7. A cove fixture for indirect lighting comprising:

an elongated trough body having a first generally vertically extending wall means for mounting to a building structure and a second wall means extending outwardly and upwardly from the lower extremity of said first wall means;

a first guideway extending lengthwise along an inner face of said first wall means;

a second guideway supported by said second wall means and extending lengthwise along said body, said guideways lying in spaced opposition one to the other; and lamp-supporting plate means having opposite edges thereof slidably mounted in said first and second guideways, respectively, whereby one or more lamps received within said body may be longitudinally adjusted along said body to provide optimum light distribution in a room wherein said fixture is mounted.

8. A cove fixture according to claim 7 including a pair of sockets spaced one from the other mounted on said lamp-supporting plate means for receiving a fluorescent lamp therebetween.

9. A fixture according to claim 7 including a plurality of lamp-supporting plate means having opposite edges thereof slidably mounted in said first and second guideways, respectively, a pair of socket means spaced one from the other mounted on each said lamp-supporting plate means for receiving a lamp therebetween whereby discrete lamps may be adjusted along said body to provide optimum light distribution in a room where said fixture is mounted.

10. A fixture according to claim 9 wherein each of said lamp-supporting plate means comprises a pair of plates each having opposite edges thereof slidably mounted in said guideways, respectively, whereby said plates, the sockets carried thereby and the lamp therebetween, may be slidably adjusted along said body as a unit.

11. A cove fixture for indirect lighting comprising:

an extruded elongated trough body having a first generally vertically extending wall means for mounting to a building structure and a second wall means extending outwardly and upwardly from the lower extremity of said first wall means;

a third wall means extending upwardly from an inner face of said second wall means;

first support means extending lengthwise on an inner face of said first wall means;

second support means extending lengthwise on one face of said third wall means and facing in substantially horizontal alignment said first support means;

lamp-supporting plate means having opposite ends thereof removably and slidably mounted in said first and second support means, whereby one or more lamps received within said body may be longitudinally adjusted therein to provide optimum light distribution in a room wherein said fixture is mounted; and engageable means extending lengthwise along the inner face of said second wall means; said third wall means having the lower extremity thereof removably engaged in said engageable means.

12. A cove fixture for indirect lighting comprising:

an extruded elongated trough body having a first generally vertically extending wall means for mounting to a building structure and a second wall means extending outwardly and upwardly from the lower extremity of said first wall means;

a third wall means extending upwardly from an inner face of said second wall means;

first support means extending lengthwise on an inner face of said first wall means;

second support means extending lengthwise on one face of said third wall means and facing in substantially horizontal alignment said first support means;

lamp-supporting plate means having opposite ends thereof removably and slidably mounted in said first and second support means, whereby one or more lamps received within said body may be longitudinally adjusted therein to provide optimum light distribution in a room wherein said fixture is mounted, said first and second wall means having oppositely disposed free extremities each defining a lip, said fixture further comprising a relfector having opposite edges engagedly received by said lips.

13. A fixture as defined in claim 12, further comprising socket means fastened to said plate means; said reflector extending between said socket means; and at least one fluorescent lamp engaged in said socket means and extending at a distance above said reflector.

14. A fixture as defined in claim 13, wherein said socket means comprises a pair of sockets fastened to said plate means and adapted to support a pair of fluorescent lamps in parallel relationship over said reflector.

15. A fixture as defined in claim 13, wherein said plate means has a width to receive a pair of back-to-back socket means.

16. A cove fixture for indirect lighting comprising:

an extruded elongated trough body having a first generally vertically extending wall means for mounting to a building structure and a second wall means extending outwardly and upwardly from the lower extremity of said first wall means;

a third wall means extending upwardly from an inner face of said second wall means;

first support means extending lengthwise on an inner face of said first wall means;

second support means extending lengthwise on one face of said third wall means and facing in substantially horizontal alignment said first support means;

lamp-supporting plate means having opposite ends thereof removably and slidably mounted in said first and second support means, whereby one or more lamps received within said body may be longitudinally adjusted therein to provide optimum light distribution in a room wherein said fixture is mounted, said fixture further comprising third support means extending lengthwise of the inner face of said second wall means for supporting a ballast device for a fluorescent lamp used with said cove fixture; and groove means in the inner faces of at least one of said first and second walls for receiving therein coupling means for securing a juxtaposed similarly-constructed cove fixture in longitudinal alignment with said trough body.

17. A cove fixture for indirect lighting comprising:

an extruded elongated trough body having a first generally vertically extending wall means for mounting to a building structure and a second wall means extending outwardly and upwardly from the lower extremity of said first wall means;

a third wall means extending upwardly from an inner face of said second wall means;

first support means extending lengthwise on an inner face of said first wall means;

second support means extending lengthwise on one face of said third wall means and facing in substantially horizontal alignment said first support means;

lamp-supporting plate means having opposite ends thereof removably and slidably mounted in said first and second support means, whereby one or more lamps received within said body may be longitudinally adjusted therein to provide optimum light distribution in a room wherein said fixture is mounted, said first support means consisting of a groove integrally formed in said first wall means.

18. A cove fixture for indirect lighting comprising:

an extruded elongated trough body having a first generally vertically extending wall means for mounting to a building structure and a second wall means extending outwardly and upwardly from the lower extremity of said first wall means; a third wall means extending upwardly from an inner face of said second wall means;

first support means extending lengthwise on an inner face of said first wall means;

second support means extending lengthwise on one face of said third wall means and facing in substantially horizontal alignment said first support means;

lamp-supporting plate means having opposite ends thereof removably and slidably mounted in said first and second support means, whereby one or more lamps received within said body may be longitudinally adjusted therein to provide optimum light distribution in a room wherein said fixture is mounted, said second support means consisting of a groove integrally formed in said third wall means.

* * * * *